US009062925B1

(12) United States Patent
Viani

(10) Patent No.: US 9,062,925 B1
(45) Date of Patent: Jun. 23, 2015

(54) ENHANCED TRIGGER CONTROL CONNECTOR

(71) Applicant: Arthur Viani, Miami, FL (US)

(72) Inventor: Arthur Viani, Miami, FL (US)

( * ) Notice: Subject to any disclaimer, the term of this patent is extended or adjusted under 35 U.S.C. 154(b) by 46 days.

(21) Appl. No.: 13/737,011

(22) Filed: Jan. 9, 2013

(51) Int. Cl.
*F41A 19/10* (2006.01)

(52) U.S. Cl.
CPC ..... *F41A 19/10* (2013.01)

(58) Field of Classification Search
CPC ..... F41A 19/10–19/16
USPC ..... 42/69.01, 69.03
See application file for complete search history.

(56) References Cited

U.S. PATENT DOCUMENTS 5,822,903 A * 10/1998 Davis, Sr. ..... 42/69.01
6,354,032 B1 * 3/2002 Viani ..... 42/69.03
2006/0236581 A1 * 10/2006 Viani ..... 42/69.01

* cited by examiner

*Primary Examiner* — Stephen M Johnson
*Assistant Examiner* — Benjamin Gomberg
(74) *Attorney, Agent, or Firm* — Albert Bordas, P.A.

(57) ABSTRACT

A firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

20 Claims, 9 Drawing Sheets

ENHANCED TRIGGER CONTROL CONNECTOR

BACKGROUND OF THE INVENTION

1. Field of the Invention

The present invention relates to firearms, and more particularly, to a firearm enhanced trigger control connector.

2. Description of the Related Art

Firearms are mostly utilized by law enforcement, sport enthusiasts, and private owners for target and game. While participating in sport or especially during moments of self defense, it is desirable to discharge the firearm with minimal trigger travel distance and obstructions to allow for quick firing and rapid succession. In addition to rapid firing, precision shooting is an aim that is strived for.

In most semi-automatic firearms that have an enclosed striker assembly, as the trigger is pulled, the trigger bar slidably travels generally in a rearward and downward direction establishing undesired trigger pull excess travel. In addition, as the trigger bar slidably travels generally in the rearward and downward direction, it makes contact with a lip designed to contain the trigger bar. The lip, being an obstruction, causes a user to exert a second force to overcome the obstruction after exerting an initial force to pull the trigger. Thus, resulting in a reduction of accuracy and precision when firing.

There are no similar enhanced trigger control connectors to the best of applicant's knowledge that are built-in the firearms to prevent undesired trigger pull excess travel while minimizing trigger bar obstruction.

SUMMARY OF THE INVENTION

A firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

It is therefore one of the main objects of the present invention to provide an enhanced trigger control connector for firearms utilized to correct a trigger bar obstruction.

It is another object of the present invention to provide an enhanced trigger control connector for firearms to minimize trigger bar obstruction while it is traveling generally in a rearward and downward direction as the trigger is pulled, defining undesired trigger pull excess travel.

It is another object of the present invention to provide an enhanced trigger control connector for firearms to prevent over manipulation of the trigger, which causes a reduction of accuracy while repetitive firing.

It is another object of the present invention to increase the speed of firing a firearm with a reduced trigger travel distance.

It is another object of the present invention to provide an enhanced trigger control connector for firearms utilized with semi-automatic pistols that have an enclosed striker assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
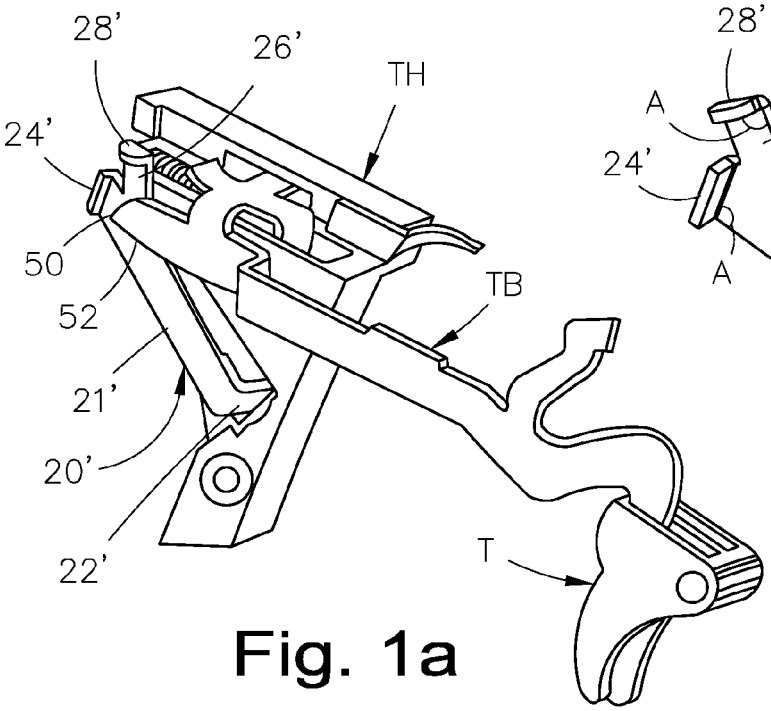
Fig. 1a PRIOR ART
FIG. 1*a* is an isometric view of the prior art trigger connector mounted onto a trigger bar and housing.

Referring now to the drawings, where the present invention is generally referred to with numeral 10, it can be observed that it basically includes enhanced trigger control connector 20, bent at predetermined locations to permit its mechanical transactions to effectuate a trigger control connector mechanism for minimizing trigger pull excess travel and torsion force effects.

Figure 1:
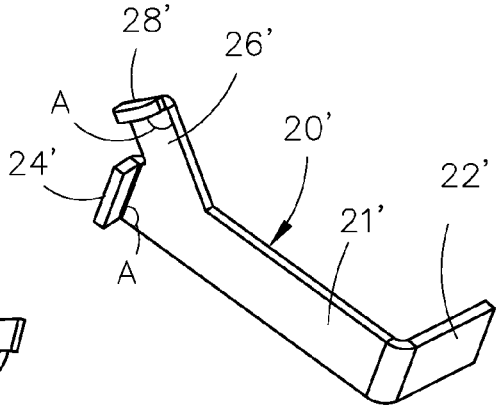
Fig. 1 PRIOR ART
FIG. 1 is an isometric view of a prior art trigger connector.

Seen in FIGS. 1 and 1*a* is prior art connector 20'. Torso 21' has lip 24'. Lip 24' serves to contain trigger bar TB when biased against it. Lip 24' is at angle A. Angle A is approximately 90 degrees. Connector leg 26' extends from torso 21' at a predetermined angle and has connector lip 28'. Connector lip 28' is at angle A from connector leg 26'. Angle A is approximately 90 degrees. Opposite in direction from connector lips 24' and 28' is connector leg 22'. FIG. 1*a* illustrates trigger bar TB secured onto trigger housing TH. Connector leg 22' removably fits within firearm F, seen in FIG. 2, to remain secured.

Figure 2:
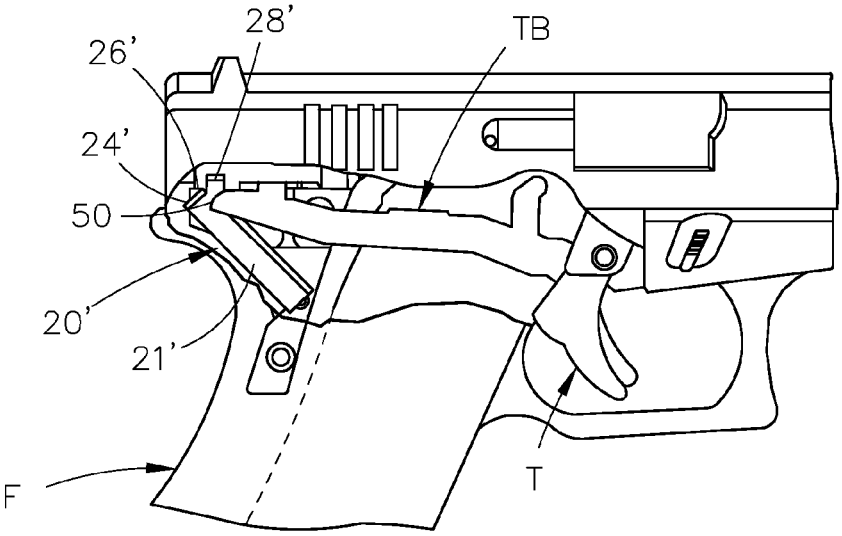
Fig. 2 PRIOR ART
FIG. 2 is an elevation view of the prior art trigger connector mounted onto the trigger bar and housing, before firing a firearm.

As seen in FIG. 2, prior art connector 20' works in conjunction with trigger bar TB. While firearm F, is in the rest position, trigger bar TB is biased against torso 21'. As trigger T is pulled, trigger bar TB slidably travels generally in a rearward and downward direction establishing undesired trigger pull excess travel.

Figure 2A:
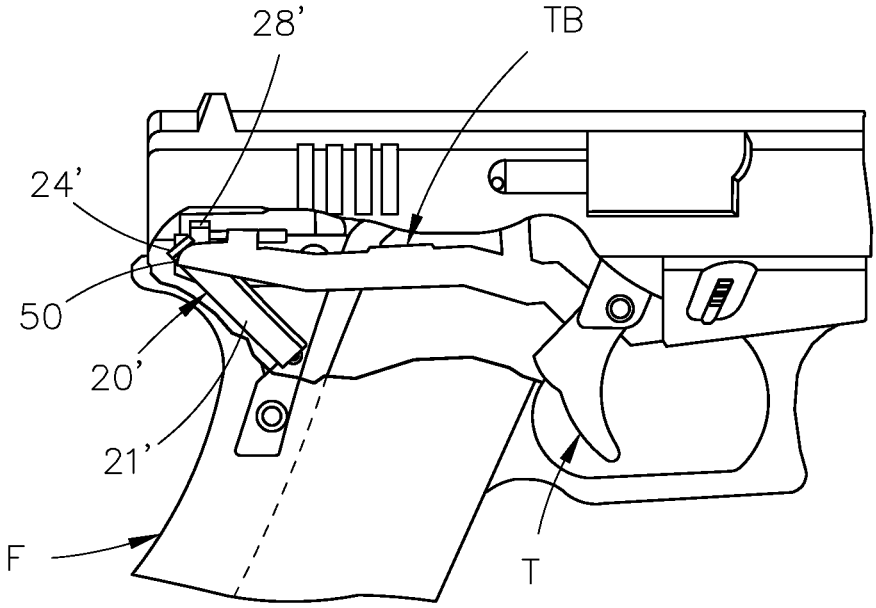
Fig. 2a PRIOR ART
FIG. 2*a* is an elevation view of the prior art trigger connector seen in FIG. 2, at the point of firing the firearm.

As seen in FIG. 2*a*, connector lip 24' serves to guide curved end 50. However, due to its position and angle A, connector lip 24' also is an obstruction. This obstruction causes a user to exert a second force to overcome the obstruction after exerting an initial force to pull trigger T. Thus, resulting in a reduction of accuracy and precision when firing. Trigger bar TB remains biased against torso 21' at the point of firing.

Figure 2B:
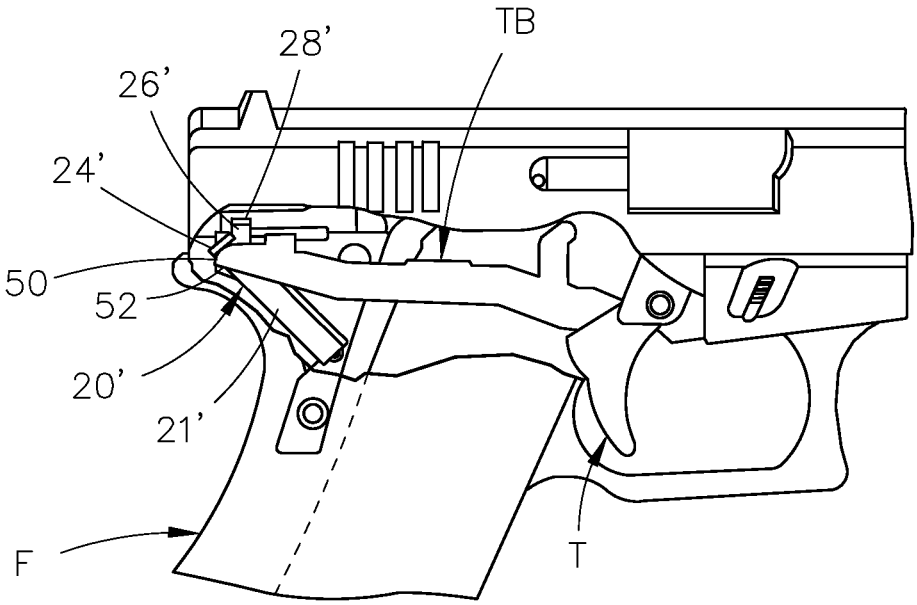
Fig. 2b PRIOR ART
FIG. 2*b* is an elevation view of the prior art trigger connector seen in FIG. 2*a*, after firing the firearm.

As seen in FIG. 2*b*, after the point of firing, trigger bar TB continuous to travel generally in a rearward and downward direction until a spring force, not shown, causes trigger bar TB to shift. Guided by connector lip 28', edge 52 of trigger bar TB slidably travels generally in a forward and upward direction until completing the operating cycle.

Figure 3A:
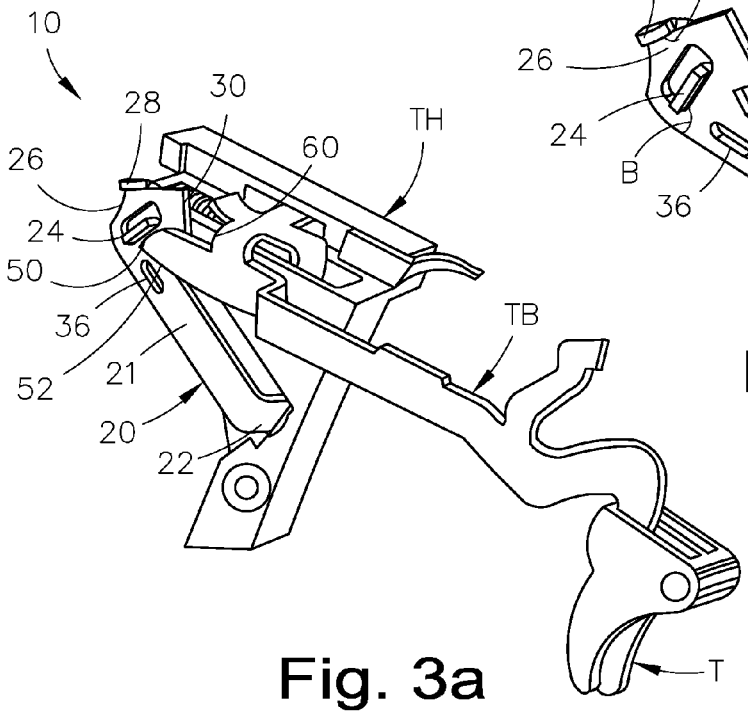
FIG. 3*a* is an isometric view of the present invention mounted onto a trigger bar and housing.
Figure 3:
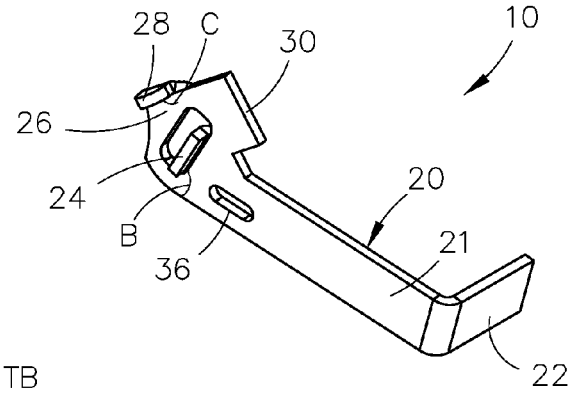
FIG. 3 is an isometric view of the present invention.

Seen in FIGS. 3 and 3*a* is enhanced trigger control connector 20. Torso 21 has guide tab 24 at predetermined angle B that is approximately between 68 degrees and 78 degrees; and in a preferred embodiment is approximately 75 degrees. Guide tab 24 serves to contain trigger bar TB when biased against it. Torso 21 also has debris slot 36. Connector leg 26 extends from torso 21 at a predetermined angle and has disconnector tab, also defined as a reset tab, 28. It is noted that disconnector tab 28 is located at a predetermined positioned forward and elevated as compared to connector lip 28' and is at predetermined angle C. Predetermined angle C is approximately between 81 degrees and 91 degrees; and in a preferred embodiment is approximately 86 degrees. Extending from connector leg 26 is control tab 30. Approximately opposite in direction from guide tab 24 and disconnector tab 28 is connector leg 22. FIG. 3*a* illustrates trigger bar TB secured onto trigger housing TH. Connector leg 22 removably fits within firearm F, seen in FIG. 4, to remain secured.

Figure 4:
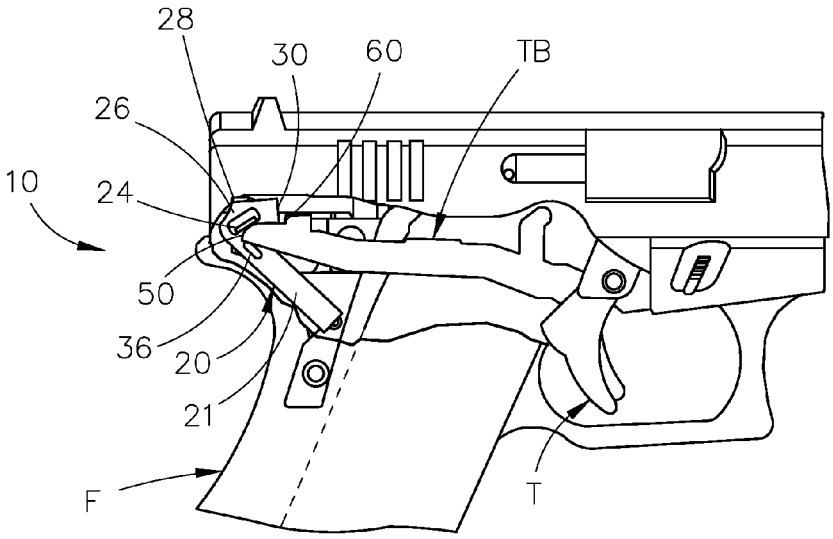
FIG. 4 is an elevation view of the present invention mounted onto the trigger bar and housing, before firing the firearm.

As seen in FIG. 4, firearm F is in the rest position. Once a user grasps firearm F, aims, and is ready to fire, the user exerts a force to overcome the force of trigger T. Trigger T is mechanically connected to trigger bar TB. In the rest position, trigger bar TB is biased against torso 21. It is noted that guide tab 24 is located at a predetermined positioned forward and elevated as compared to connector lip 24' and has predetermined angle B to contain trigger bar TB when biased against it.

More specifically, guide tab 24 is positioned at a predetermined angle B, whereby curved end 50 of trigger bar TB nearly contacts, or contacts, guide tab 24 when firearm F is in the rest position, as illustrated, to eliminate undesired trigger pull obstruction and to minimize trigger pull excess travel when trigger T is pulled.

In a preferred embodiment, nearly contacts is defined as a distance up to approximately 3 mm.

As trigger T is pulled, trigger bar TB slidably travels generally in a rearward and downward direction and guide tab 24 serves to guide curved end 50 with no obstruction. The no obstruction is achieved with predetermined angle B for guide tab 24, saving the user from exerting a second force after exerting an initial force to pull trigger T. Thus, resulting in improved accuracy and precision when firing. Trigger bar TB remains biased against torso 21 at the point of firing.

Figure 4A:
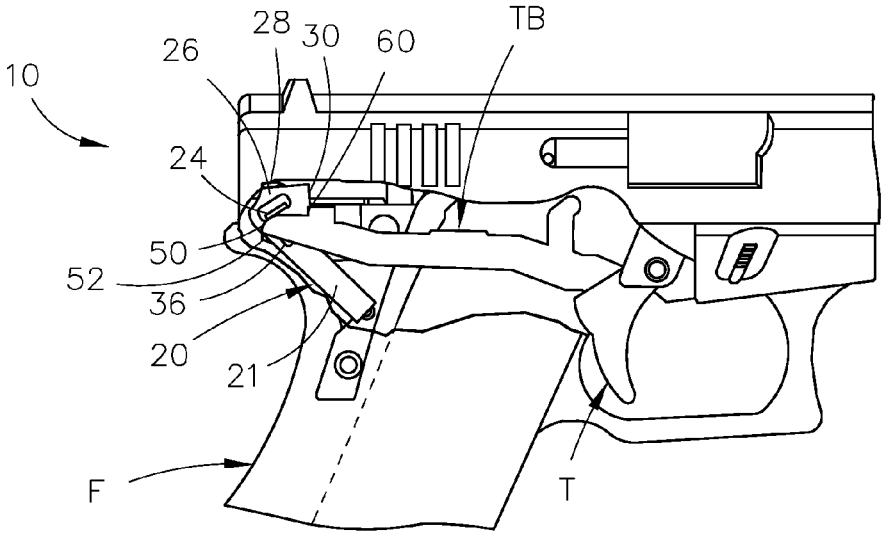
FIG. 4*a* is an elevation view of the present invention seen in FIG. 4, after firing the firearm.

As seen in FIG. 4*a*, after the point of firing, trigger bar TB continuous to travel generally in a rearward and downward direction. Cross edge 60 contacts control tab 30. Control tab 30 is designed as a specific contact to prevent over-travel of trigger bar TB when operating in cooperation with trigger T of firearm F, and a spring force, not shown, causes trigger bar TB to shift. Guided by disconnector tab 28, edge 52 of trigger bar TB then slidably travels generally in a forward and upward direction until completing the operating cycle. Control tab 30 establishes a shortened trigger travel distance. With a shortened trigger travel distance, less time is required for the user to discharge firearm F. As a result, the user benefits from each subsequent discharge with less time required for firearm F to cycle back into the rest position, as in FIG. 4. Debris slot 36 is designed to minimize debris accumulation between trigger bar TB and enhanced trigger control connector 20.

Figure 5:
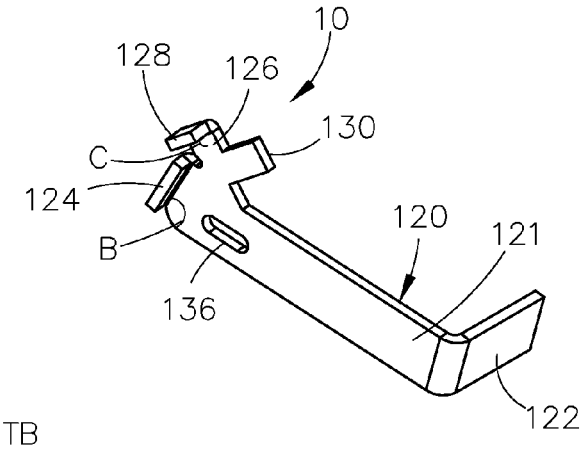
FIG. 5 is an isometric view of a first alternate embodiment of the present invention.
Figure 5A:
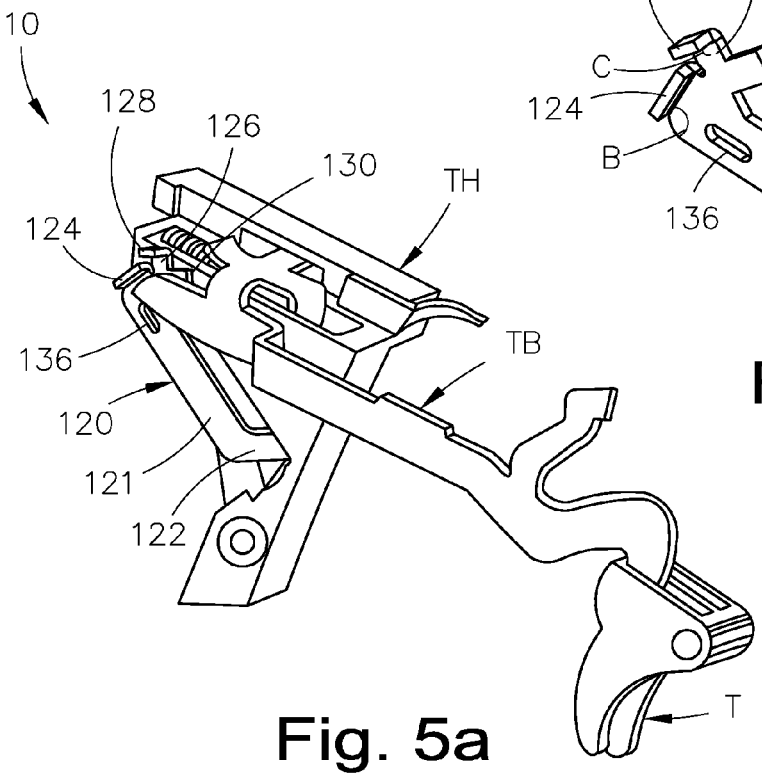
FIG. 5*a* is an isometric view of the first alternate embodiment of the present invention mounted onto a trigger bar and housing.

Seen in FIGS. 5 and 5*a* is a first alternate embodiment of the present invention, defined as enhanced trigger control connector 120. Torso 121 has guide angle 124 at predetermined angle B that is approximately between 68 degrees and 78 degrees; and in a preferred embodiment is approximately 75 degrees. Guide angle 124 serves to contain trigger bar TB when biased against it. Torso 121 also has debris slot 136. Connector leg 126 extends from torso 121 at a predetermined angle and has disconnector tab, also defined as a reset tab, 128. It is noted that disconnector tab 128 is located at a predetermined positioned forward and elevated as compared to connector lip 28' and is at predetermined angle C. Predetermined angle C is approximately between 81 degrees and 91 degrees; and in a preferred embodiment is approximately 86 degrees. Extending from connector leg 126 is control tab 130. Approximately opposite in direction from guide angle 124 and disconnector tab 128 is connector leg 122. FIG. 5*a* illustrates trigger bar TB secured onto trigger housing TH. Connector leg 122 removably fits within firearm F, seen in FIG. 6, to remain secured.

Figure 6:
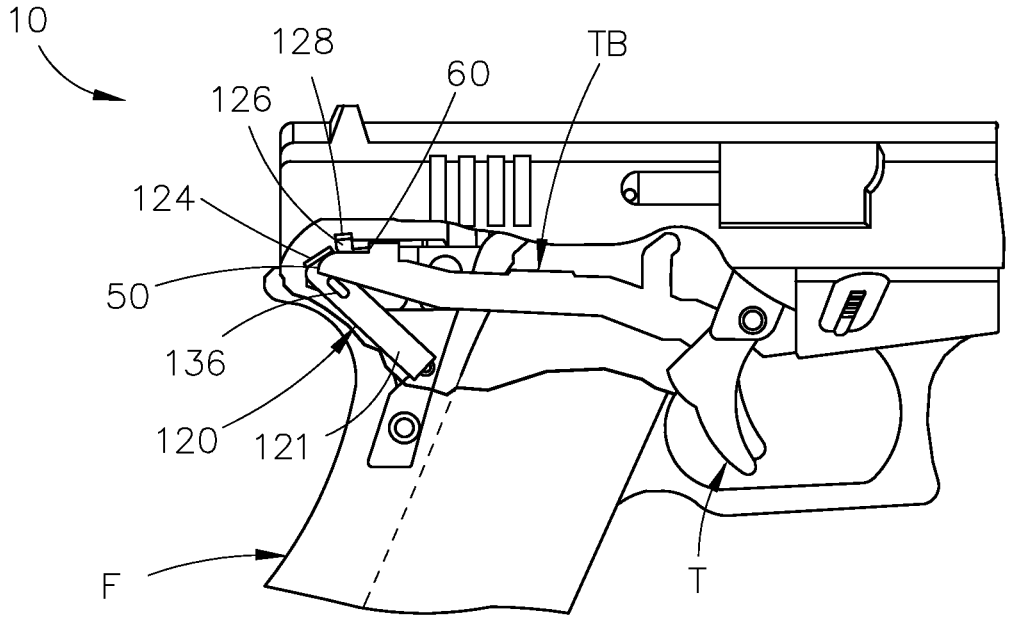
FIG. 6 is an elevation view of the first alternate embodiment of the present invention mounted onto the trigger bar and housing, before firing the firearm.

As seen in FIG. 6, firearm F is in the rest position. Once a user grasps firearm F, aims, and is ready to fire, the user exerts a force to overcome the force of trigger T. Trigger T is mechanically connected to trigger bar TB. In the rest position, trigger bar TB is biased against torso 121. It is noted that guide angle 124 is located at a predetermined positioned forward and elevated as compared to connector lip 24' and has predetermined angle B to contain trigger bar TB when biased against it.

More specifically, guide angle 124 is positioned at a predetermined angle B, whereby curved end 50 of trigger bar TB nearly contacts, or contacts, guide angle 124 when firearm F is in the rest position, as illustrated, to eliminate undesired trigger pull obstruction and to minimize trigger pull excess travel when trigger T is pulled.

In a preferred embodiment, nearly contacts is defined as a distance up to approximately 3 mm.

As trigger T is pulled, trigger bar TB slidably travels generally in a rearward and downward direction and guide angle 124 serves to guide curved end 50 with no obstruction. The no obstruction is achieved with predetermined angle B for guide angle 124, saving the user from exerting a second force after exerting an initial force to pull trigger T. Thus, resulting in improved accuracy and precision when firing. Trigger bar TB remains biased against torso 121 at the point of firing.

Figure 6A:
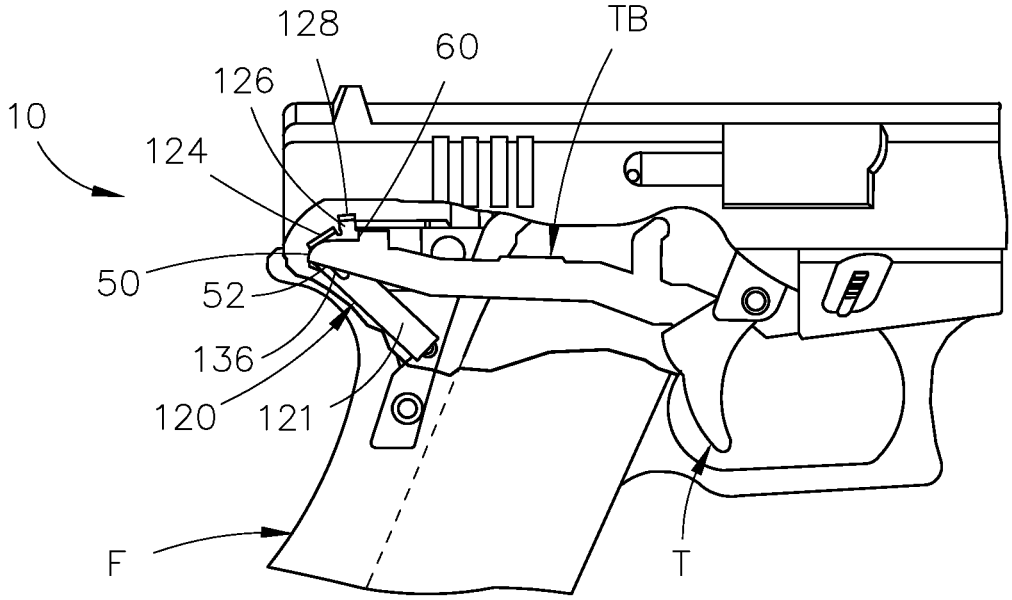
FIG. 6*a* is an elevation view of the first alternate embodiment of the present invention seen in FIG. 6, after firing the firearm.

As seen in FIG. 6*a*, after the point of firing, trigger bar TB continuous to travel generally in a rearward and downward direction. Cross edge 60 contacts control tab 130. Control tab 130 is designed as a specific contact to prevent over-travel of trigger bar TB when operating in cooperation with trigger T of firearm F, and a spring force, not shown, causes trigger bar TB to shift. Guided by disconnector tab 128, edge 52 of trigger bar TB then slidably travels generally in a forward and upward direction until completing the operating cycle. Control tab 130 establishes a shortened trigger travel distance. With a shortened trigger travel distance, less time is required for the user to discharge firearm F. As a result, the user benefits from each subsequent discharge with less time required for firearm F to cycle back into the rest position, as in FIG. 6. Debris slot 136 is designed to minimize debris accumulation between trigger bar TB and enhanced trigger control connector 120.

Figure 7:
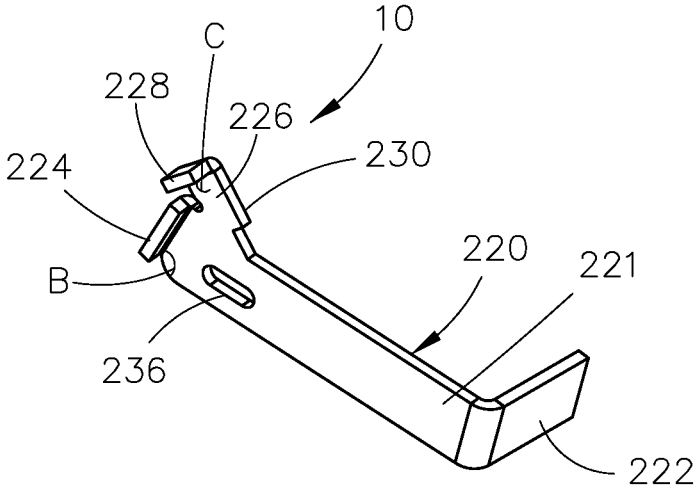
FIG. 7 is an isometric view of a second alternate embodiment of the present invention.
Figure 7A:
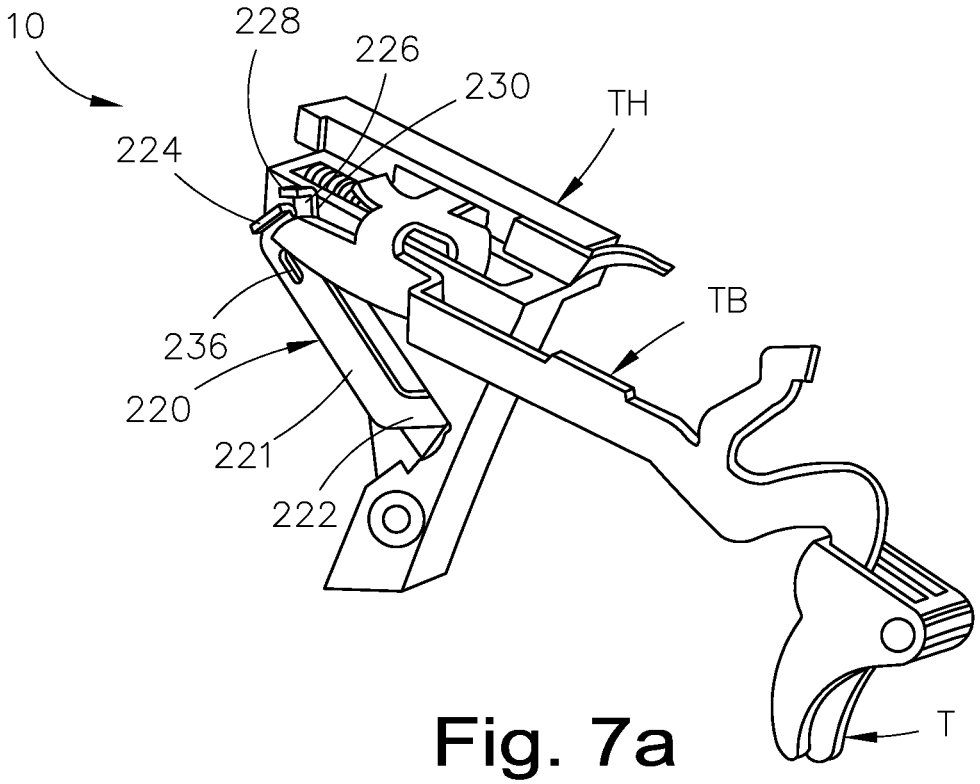
FIG. 7*a* is an isometric view of the second alternate embodiment of the present invention mounted onto a trigger bar and housing.

Seen in FIGS. 7 and 7*a* is a second alternate embodiment of the present invention, defined as enhanced trigger control connector 220. Torso 221 has guide angle 224 at predetermined angle B that is approximately between 68 degrees and 78 degrees; and in a preferred embodiment is approximately 75 degrees. Guide angle 224 serves to contain trigger bar TB when biased against it. Torso 221 also has debris slot 236. Connector leg 226 extends from torso 221 at a predetermined angle and has disconnector tab, also defined as a reset tab, 228. It is noted that disconnector tab 228 is located at a predetermined positioned forward and elevated as compared to connector lip 28' and is at predetermined angle C. Predetermined angle C is approximately between 81 degrees and 91 degrees; and in a preferred embodiment is approximately 86 degrees. Extending from connector leg 226 is control tab 230. Approximately opposite in direction from guide angle 224 and disconnector tab 228 is connector leg 222. FIG. 7*a* illustrates trigger bar TB secured onto trigger housing TH. Connector leg 222 removably fits within firearm F, seen in FIG. 8, to remain secured.

Figure 8:
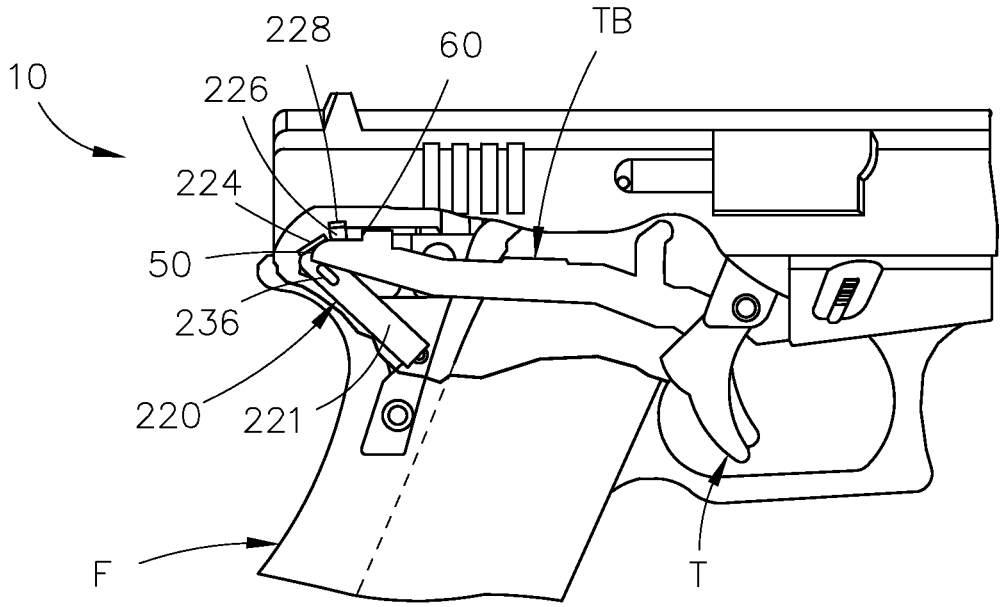
FIG. 8 is an elevation view of the second alternate embodiment of the present invention mounted onto the trigger bar and housing, before firing the firearm.

As seen in FIG. 8, firearm F is in the rest position. Once a user grasps firearm F, aims, and is ready to fire, the user exerts a force to overcome the force of trigger T. Trigger T is mechanically connected to trigger bar TB. In the rest position, trigger bar TB is biased against torso 221. It is noted that guide angle 224 is located at a predetermined positioned forward and elevated as compared to connector lip 24' and has predetermined angle B to contain trigger bar TB when biased against it.

More specifically, guide angle 224 is positioned at a predetermined angle B, whereby curved end 50 of trigger bar TB nearly contacts, or contacts, guide angle 224 when firearm F is in the rest position, as illustrated, to eliminate undesired trigger pull obstruction and to minimize trigger pull excess travel when trigger T is pulled.

In a preferred embodiment, nearly contacts is defined as a distance up to approximately 3 mm.

As trigger T is pulled, trigger bar TB slidably travels generally in a rearward and downward direction and guide angle 224 serves to guide curved end 50 with no obstruction. The no obstruction is achieved with predetermined angle B for guide angle 224, saving the user from exerting a second force after exerting an initial force to pull trigger T. Thus, resulting in improved accuracy and precision when firing. Trigger bar TB remains biased against torso 221 at the point of firing.

Figure 8A:
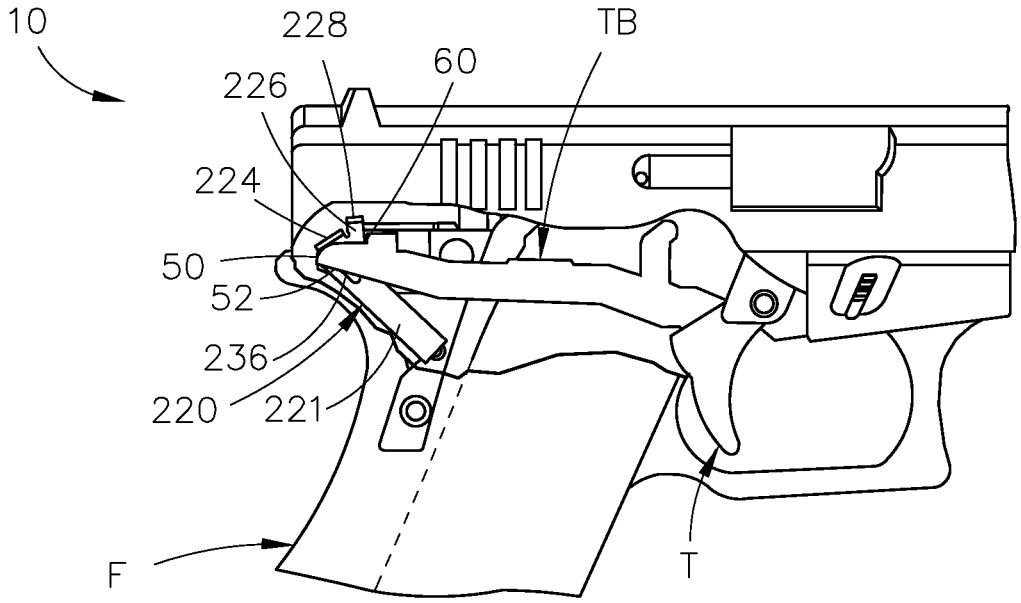
FIG. 8*a* is an elevation view of the second alternate embodiment of the present invention seen in FIG. 8, after firing the firearm.

As seen in FIG. 8*a*, after the point of firing, trigger bar TB continuous to travel generally in a rearward and downward direction. Cross edge 60 contacts control tab 230. Control tab 230 is designed as a specific contact to prevent over-travel of trigger bar TB when operating in cooperation with trigger T of firearm F, and a spring force, not shown, causes trigger bar TB to shift. Guided by disconnector tab 228, edge 52 of trigger bar TB then slidably travels generally in a forward and upward direction until completing the operating cycle. Control tab 230 establishes a shortened trigger travel distance. With a shortened trigger travel distance, less time is required for the user to discharge firearm F. As a result, the user benefits from each subsequent discharge with less time required for firearm F to cycle back into the rest position, as in FIG. 8. Debris slot 236 is designed to minimize debris accumulation between trigger bar TB and enhanced trigger control connector 220.

Figure 9:
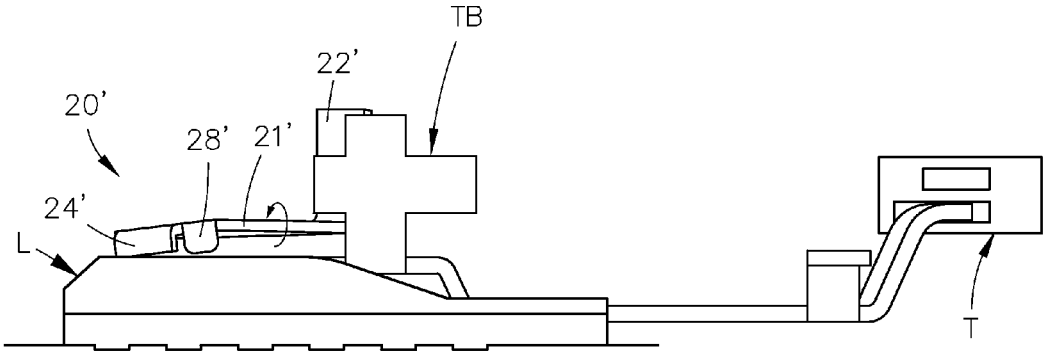
Fig. 9 PRIOR ART
FIG. 9 is a top view of the prior art trigger connector seen in FIG. 1, illustrating torsion forces while cycling.

As seen in FIG. 9, after the point of firing, trigger bar TB continues to travel generally in a rearward and downward direction. Connector lip 28' is cammed inwardly by lobe L until a spring force, not shown, causes trigger bar TB to shift. Edge 52 of trigger bar TB slidably travels generally in a forward and upward direction. Lobe L defines a ramped surface that cams connector lip 28' while cycling until completing the operating cycle. However, due to its position, connector lip 28' also is an obstruction. This obstruction causes torsion forces upon prior art connector 20' while cycling. Thus, compromising the stability and durability of prior art connector 20'.

Figure 10:
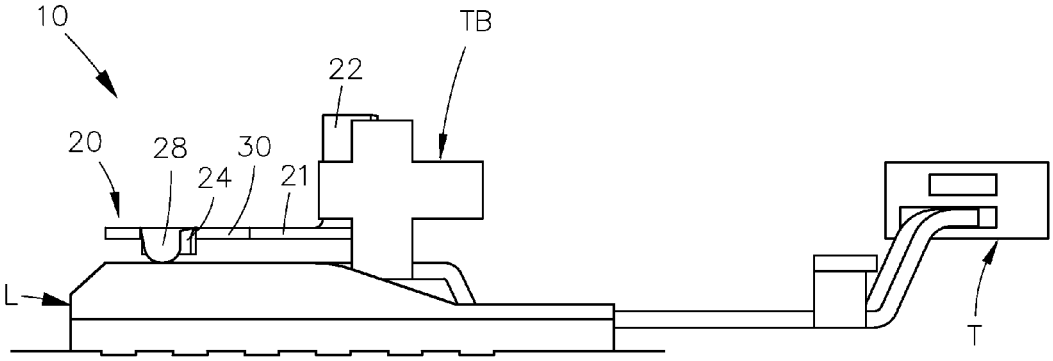
FIG. 10 is a top view of the present invention seen in FIG. 3, while cycling.

As seen in FIG. 10, after the point of firing, trigger bar TB continues to travel generally in a rearward and downward direction. Disconnector tab 28 is cammed inwardly by lobe L until a spring force, not shown, causes trigger bar TB to shift. Edge 52 of trigger bar TB slidably travels generally in a forward and upward direction. Lobe L defines a ramped surface that cams disconnector tab 28 while cycling until completing the operating cycle with minimal obstruction. The minimal obstruction is achieved with enhanced disconnector tab 28 position, minimizing torsion forces upon enhanced trigger control connector 20 while cycling. Thus, resulting in improved stability and durability.

Figure 11:
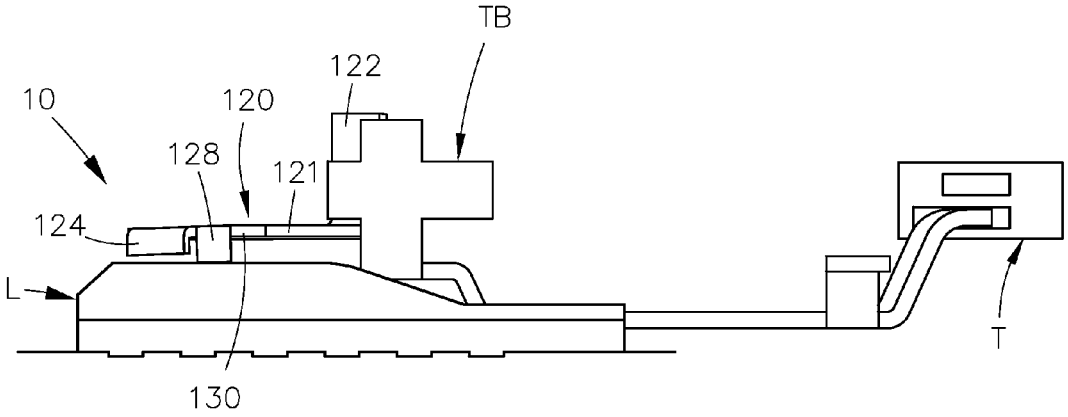
FIG. 11 is a top view of the first alternate embodiment of the present invention seen in FIG. 5, while cycling.

As seen in FIG. 11, after the point of firing, trigger bar TB continues to travel generally in a rearward and downward direction. Disconnector tab 128 is cammed inwardly by lobe L until a spring force, not shown, causes trigger bar TB to shift. Edge 52 of trigger bar TB slidably travels generally in a forward and upward direction. Lobe L defines a ramped surface that cams disconnector tab 128 while cycling until completing the operating cycle with minimal obstruction. The minimal obstruction is achieved with enhanced disconnector tab 128 position, minimizing torsion forces upon enhanced trigger control connector 120 while cycling. Thus, resulting in improved stability and durability.

Figure 12:
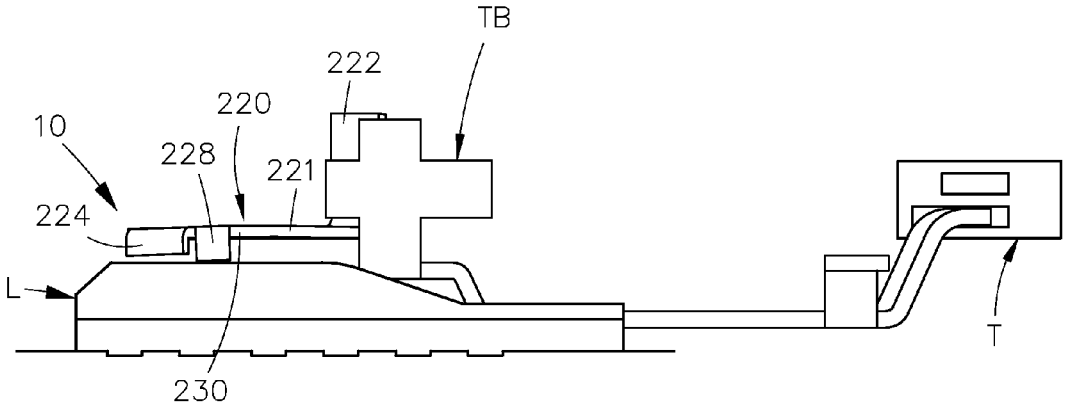
FIG. 12 is a top view of the second alternate embodiment of the present invention seen in FIG. 7, while cycling.

As seen in FIG. 12, after the point of firing, trigger bar TB continues to travel generally in a rearward and downward direction. Disconnector tab 228 is cammed inwardly by lobe L until a spring force, not shown, causes trigger bar TB to shift. Edge 52 of trigger bar TB slidably travels generally in a forward and upward direction. Lobe L defines a ramped surface that cams disconnector tab 228 while cycling until completing the operating cycle with minimal obstruction. The minimal obstruction is achieved with enhanced disconnector tab 228 position, minimizing torsion forces upon enhanced trigger control connector 220 while cycling. Thus, resulting in improved stability and durability.

Enhanced trigger control connectors 20; 120; and 220 are made out of a durable and light weight material as stainless steel, alloy metal, or other material having similar characteristics. In the preferred embodiment, enhanced trigger control connectors 20; 120; and 220 are manufactured as a single metallic piece and have a general consistent thickness throughout of approximately 0.10 mm to 2.00 mm, so as to cooperatively interact with the general trigger mechanism of semiautomatic firearms that have an enclosed striker assembly. Such a firearm may be "GLOCK", without limitation to this specific brand.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm enhancing trigger control connector, comprising: a torso comprising a guide tab positioned at a first predetermined angle, said guide tab containing a trigger bar of a firearm, said torso further comprising a first connector leg extending therefrom at a second predetermined angle, said first connector leg having a disconnector tab at a third predetermined angle, extending from said first connector leg is a control tab, said guide tab is positioned at a first predetermined distance from said first connector leg and at a second predetermined distance from said control tab, whereby a section cut from said torso defines an opening within said torso and said guide tab is bent therefrom such that said opening and said guide tab are spaced from the sides and ends of the torso, said torso further comprising a second connector leg that removably fits within a trigger housing of said firearm.

2. The firearm enhancing trigger control connector set forth in claim 1, further characterized in that said torso has a debris slot.

3. The firearm enhancing trigger control connector set forth in claim 1, further characterized in that said guide tab contains said trigger bar of said firearm when biased against said trigger bar.

4. The firearm enhancing trigger control connector set forth in claim 1, further characterized in that said trigger bar is biased against said torso when said firearm is in a rest position.

5. The firearm enhancing trigger control connector set forth in claim 1, further characterized in that said trigger bar nearly contacts said guide tab when said firearm is in a rest position.

6. The firearm enhancing trigger control connector set forth in claim 5, further characterized in that said nearly contacts is a distance up to approximately 3 mm.

7. The firearm enhancing trigger control connector set forth in claim 1, further characterized in that said trigger bar nearly contacts said guide tab when said firearm is in a rest position to eliminate trigger pull obstruction and to minimize or eliminate trigger pull excess travel when a trigger is pulled, whereby said torso has said guide tab at a predetermined angle that is approximately between 68 degrees and 78 degrees.

8. The firearm enhancing trigger control connector set forth in claim 1, further characterized in that said trigger bar contacts said guide tab when said firearm is in a rest position.

9. The firearm enhancing trigger control connector set forth in claim 1, further characterized in that said trigger bar contacts said guide tab when said firearm is in a rest position to eliminate trigger pull obstruction and to minimize or eliminate trigger pull excess travel when a trigger is pulled, whereby said torso has said guide tab at a predetermined angle that is approximately between 68 degrees and 78 degrees.

10. The firearm enhancing trigger control connector set forth in claim 1, further characterized in that as a trigger is pulled, said trigger bar slidably travels generally in a rearward and downward direction and said guide tab serves to guide a curved end of said trigger bar with no obstruction.

11. The firearm enhancing trigger control connector set forth in claim 10, further characterized in that said no obstruction is achieved with said first predetermined angle for said guide tab, saving a user from exerting a second force after exerting an initial force to pull said trigger.

12. The firearm enhancing trigger control connector set forth in claim 1, further characterized in that after a point of firing, said trigger bar continues to travel generally in a rearward and downward direction until a cross edge contacts said control tab.

13. The firearm enhancing trigger control connector set forth in claim 1, further characterized in that after a point of firing, said trigger bar continues to travel generally in a rearward and downward direction until a cross edge contacts said control tab to prevent over-travel of said trigger bar, said torso has said guide tab at a predetermined angle that is approximately between 68 degrees and 78 degrees.

14. The firearm enhancing trigger control connector set forth in claim 2, further characterized in that said debris slot is designed to minimize debris accumulation.

15. The firearm enhancing trigger control connector set forth in claim 1, further characterized in that a lobe cams said disconnector tab while cycling until completing an operating cycle with minimal obstruction.

16. The firearm enhancing trigger control connector set forth in claim 15, further characterized in that said minimal obstruction is achieved with said third predetermined angle of said disconnector tab, minimizing torsion forces while said cycling occurs.

17. The firearm enhancing trigger control connector set forth in claim 1, further characterized in that said second connector leg is approximately opposite in direction from said guide tab.

18. The firearm enhancing trigger control connector set forth in claim 1, further characterized in that said second connector leg is approximately opposite in direction from said disconnector tab.

19. The firearm enhancing trigger control connector set forth in claim 1, further characterized in that said second connector leg is approximately opposite in direction from said guide tab and said disconnector tab.

20. A firearm enhancing trigger control connector, comprising: a torso comprising a guide tab positioned at a first predetermined angle, said guide tab containing a trigger bar of a firearm, said torso further comprising a first connector leg extending therefrom at a second predetermined angle, said first connector leg having a disconnector tab at a third predetermined angle, extending from said first connector leg is a control tab, said torso further comprising a second connector leg that removably fits within a trigger housing of said firearm, said trigger bar contacting or nearly contacting said guide tab when said firearm is in a rest position, said guide tab is positioned at a first predetermined distance from said first connector leg and at a second predetermined distances from said control tab, whereby a section cut from said torso defines an opening within said torso and said guide tab is bent therefrom such that said opening and said guide tab are spaced from the sides and ends of the torso.

* * * * *